US005828277A

United States Patent [19]

Duchemin

[11] Patent Number: 5,828,277

[45] Date of Patent: Oct. 27, 1998

[54] CONTACTOR/CIRCUIT-BREAKER TYPE SWITCH DEVICE

[75] Inventor: Pierre Duchemin, Fourqueux, France

[73] Assignee: Schneider Electric SA, Boulogne-Billancourt, France

[21] Appl. No.: 678,756

[22] Filed: Jul. 11, 1996

[30] Foreign Application Priority Data

Jul. 13, 1995 [FR] France ..... 95 08636

[51] Int. Cl.[6] ..... H01H 67/02

[52] U.S. Cl. ..... 335/132; 335/202

[58] Field of Search ..... 335/131–3, 202; 200/295, 305

[56] References Cited

U.S. PATENT DOCUMENTS

| | | | |
|---|---|---|---|
| 3,882,435 | 5/1975 | Grass et al. | 335/132 |
| 4,899,120 | 2/1990 | Ohtake et al. | 335/132 |
| 5,546,062 | 8/1996 | Duchemin . | |
| 5,578,980 | 11/1996 | Olubo et al. | 335/202 |

FOREIGN PATENT DOCUMENTS

| | | |
|---|---|---|
| 0 179 677 | 4/1986 | European Pat. Off. . |
| 0 264 318 | 4/1988 | European Pat. Off. . |
| 0 309 923 | 4/1989 | European Pat. Off. . |
| 0 617 449 A1 | 9/1994 | European Pat. Off. . |

*Primary Examiner*—Lincoln Donovan
*Attorney, Agent, or Firm*—Oblon, Spivak, McClelland, Maier & Neustadt, P.C.

[57] ABSTRACT

A contactor/circuit-breaker type switch device having at least one power switching pole comprising fixed contacts (1, 2) cooperating with mobile contacts (5) coupled to an actuator member (15) actuated by a solenoid (8) or by a lock lever (12) linked to a lock (23), characterised in that the lock lever (12) actuates the mobile contact actuator member (15) directly and in that the mobile parts (10) of the solenoid actuate the actuator member (15) via a coupling lever (13) adapted to be coupled to said mobile parts (10) by a demountable coupling (19, 221) associated with locking means (14) conditioned by the status of the lock.

7 Claims, 4 Drawing Sheets

CONTACTOR/CIRCUIT-BREAKER TYPE SWITCH DEVICE

The present invention concerns a contactor/circuit-breaker type switch device having at least one power switching pole comprising fixed contacts cooperating with moving contacts linked to an actuator member operated by a solenoid or by a lock lever linked to a lock.

Contactor/circuit-breakers have power switching poles each comprising a contact bridge cooperating with fixed contacts connected to connecting terminals. The mobile contacts can be actuated, in parallel, by a solenoid (contactor), by an electromagnetic tripping device (short-circuit protection), and by a thermal protection module (protection against overloads, phase imbalance and overcurrents).

In some contactor/circuit-breakers the fixed contacts and the contact bridge of each pole are housed in an insulative cartridge forming the interrupter chamber and providing the insulation between the poles.

Patent EP-0 617 449 proposes a contactor/circuit-breaker device in which a toggle lever type mechanism actuates the contact bridge from the solenoid or from the lock, independently.

An object of the present invention is to provide a contactor/circuit-breaker device in which the effects of inertia are limited and in which demounting and replacement of the cartridges are facilitated. When the circuit-breaker is open there is no mechanical coupling between the solenoid and the switching poles.

In accordance with the invention, the device is characterised in that the lock lever actuates the mobile contact actuator member directly and the moving parts of the solenoid actuate the actuator member via a coupling lever adapted to be coupled to said moving parts by a demountable coupling associated with locking means conditioned by the status of the lock.

In accordance with one feature, the locking means comprise a guide and locking member that guides or locks the end of the lever in the demountable coupling or releases it.

In accordance with another feature, the coupling lever and the lock lever actuate an actuator member rotationally coupled to the mobile contacts, which are rotary contacts.

In accordance with another feature, each switching pole is housed in a cartridge disposed between the lock and the solenoid.

The invention will now be described in more detail with reference to embodiments given way of example and shown in the appended drawings, in which.

Figure 1:
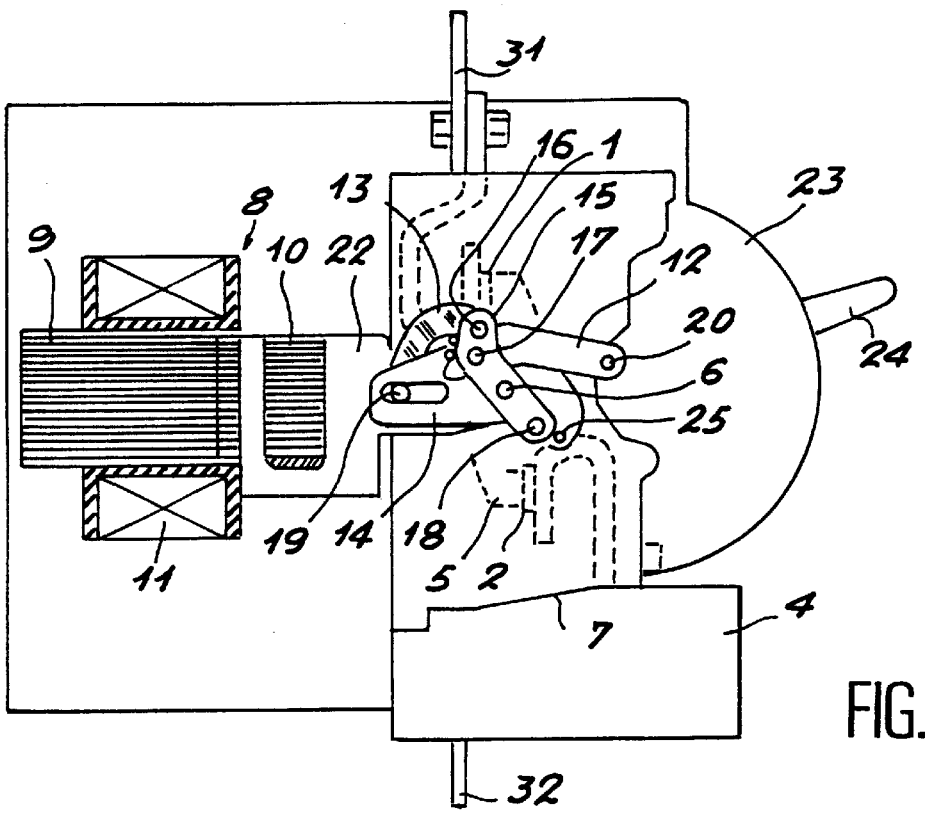
FIG. 1 is a diagram showing a device with rotary contact bridges with the contacts closed in a contactor or circuit-breaker mode of operation.
Figure 2:
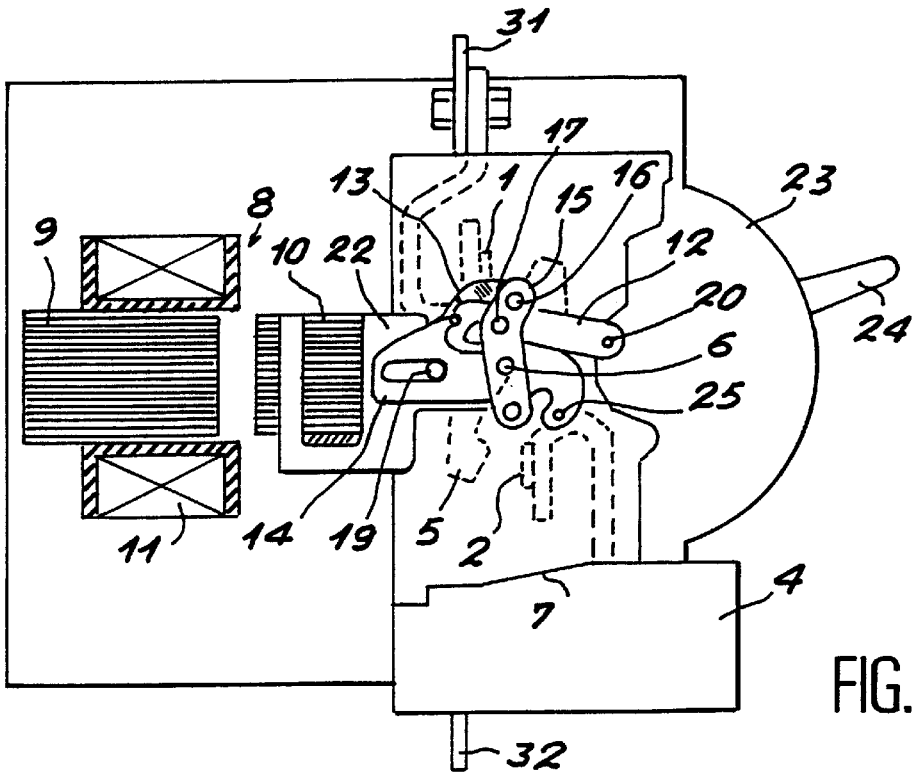
FIG. 2 is a diagram showing the device from FIG. 1 shown in a contactor operating mode with the contacts open.
Figure 3:
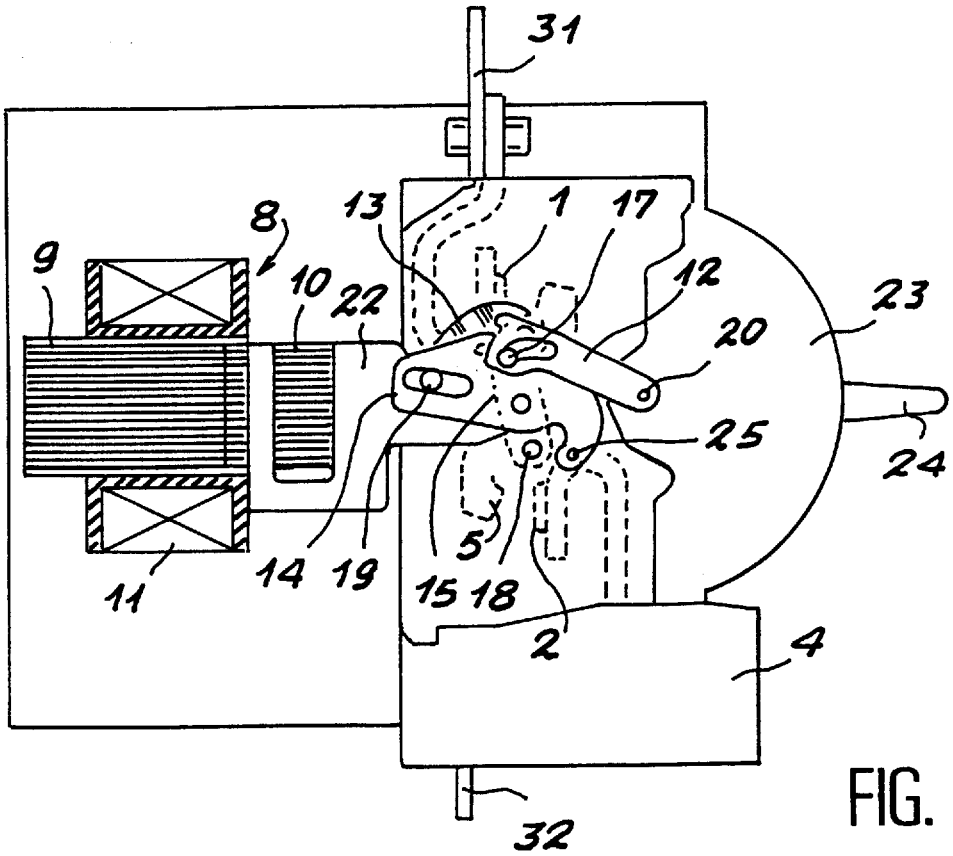
FIG. 3 is a diagram showing the device from FIGS. 1 and 2 in a circuit-breaker operating mode with the contacts open.
Figure 4:
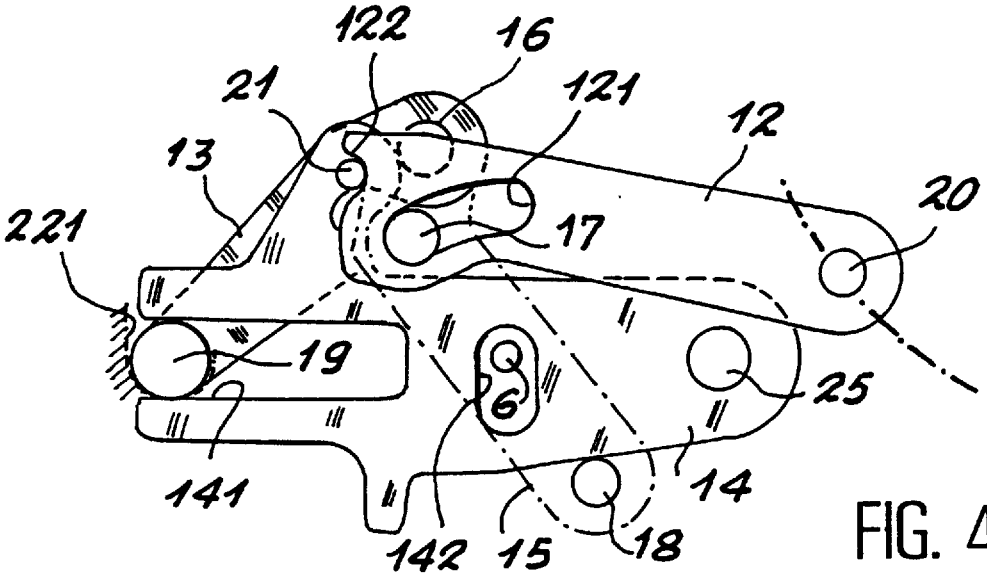
FIG. 4 shows a detail of the contact bridge actuator mechanism separate from the lock and the solenoid.
Figure 5:
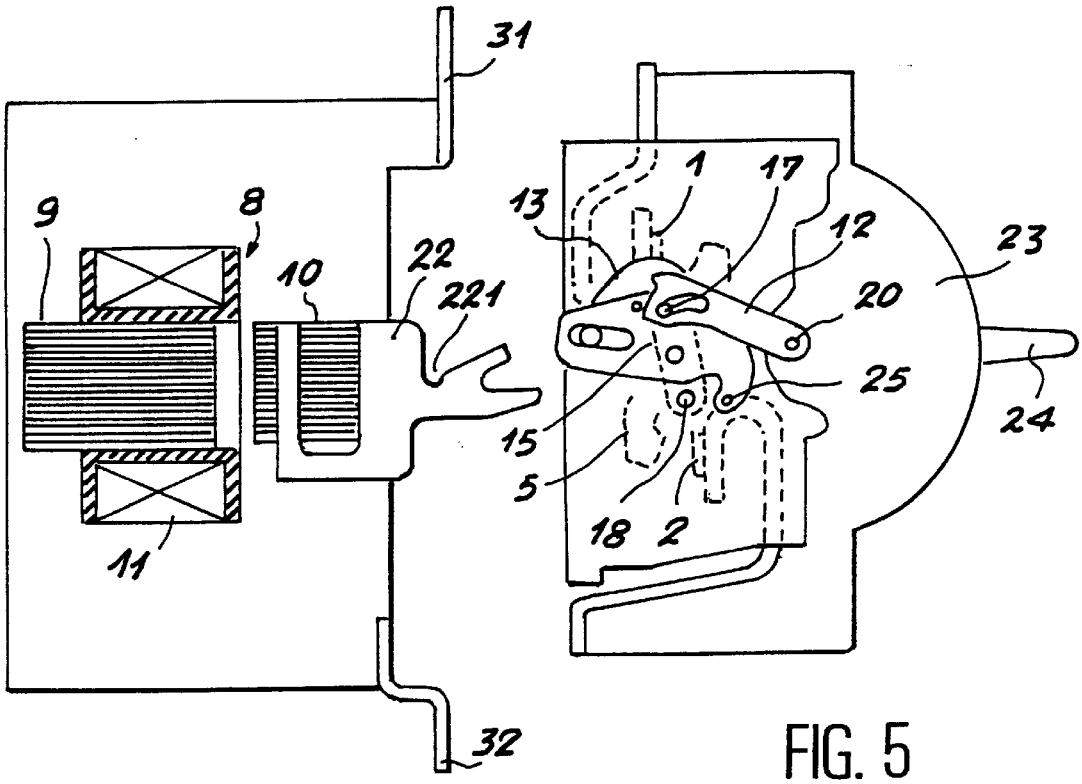
FIG. 5 is a view of the device during demounting.

The contactor/circuit-breaker type switch device shown in the drawings comprises a plurality of double-break power switching poles. Each power switching pole includes a set of fixed contacts 1 and 2 connected to two connecting lands 31 and 32 provided with terminals and a mobile contact bridge 5 cooperating with these fixed contacts 1 and 2 to make or break the circuit between the terminals. The terminals are used to connect external electrical conductors.

The contact bridge 5 is mounted on an insulative material bridge support.

The fixed contacts and the mobile assembly including the contact bridge of one switching pole are housed in an insulative cartridge 7 forming an interrupter chamber and providing insulation between the switching poles. The various cartridges 7 are disposed side by side between the solenoid 8 and the lock 23. Each cartridge 7 contains de-ioniser fins in addition to the fixed contacts, the contract bridge and the associated bridge support.

The solenoid 8 that actuates the mobile contacts comprises a fixed magnetic circuit 9, a magnetic circuit 10 that is mobile in translation and a coil 11. The coil 11 is provided with power supply terminals that are accessible from outside the casing. A return spring (not shown) operates on the mobile magnetic circuit 10.

The contact actuator member 15 is articulated by a pin 16 to a connecting lever 13 that can be moved by the mobile magnetic circuit 10 of the solenoid. To enable it to hook onto a slider 22 attached to the mobile armature 10, the end of the lever 13 has a finger 19 that can engage in a hook 221 on the slider 22. The demountable end 19 of the lever 13 is associated with a locking or guide member 14 that can pivot about a pin 25 on the casing. To this end, the finger 19 is guided to move in translation in a straight slideway 141 on the locking member 14.

The contactor/circuit-breaker has a lock 23 at the front. The contact actuator member 15 is linked to the lock 23 by a lock lever 12. The lever 12 is articulated to the mobile parts of the lock 23 by a pin 20 and is linked to the mobile contact actuator member 15 by a sliding and articulated assembly 121.

A tripping module 4 is mounted on the device to provide the protection functions.

In the embodiment of FIGS. 1 through 8 in which the contact bridges are rotary bridges, the bridge support is guided in rotation about a pivot pin 6. The middle part of the contact bridge 5 is housed in a housing on the support so that it can pivot relative to the support. The contact pressure is provided by springs tending to move the contact bridge 5 relative to the support.

The contact actuator member 15 is a crank 15 linked to the bridge support and which therefore pivots about the pin 6. This crank moves outside the cartridge.

The lock lever 12 is assembled to the actuator member 15 by an actuator rod 17 attached to the crank 15 and sliding in a slot 121 in the lock lever 12. This assembly enables relative movement of the rod 17 and the member 15 in the contactor mode of operation.

The lock lever 12 has a notch 122 in which a lug 21 on the locking member 14 can engage. When the lug 21 is in the notch 122 the lock lever 12 immobilises the locking member 14. The latter incorporates a slot 142 enabling relative movement.

The actuator rod 17 passes through the various bridge supports and the cranks 15. A second actuator rod 18 is also provided.

The slider 22 is forked with two branches inserted into the two spaces between two cartridges. These two spaces also accommodate the lock levers 12, the members 15, the locking members 14 and the coupling levers 13.

The operation of the device as a contactor will now be described.

Figure 6:
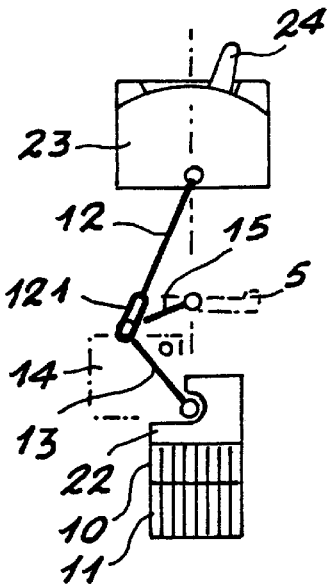
FIGS. 6, 7 and 8 are diagrams showing the operation of the device from FIGS. 1 through 5.
Figure 7:
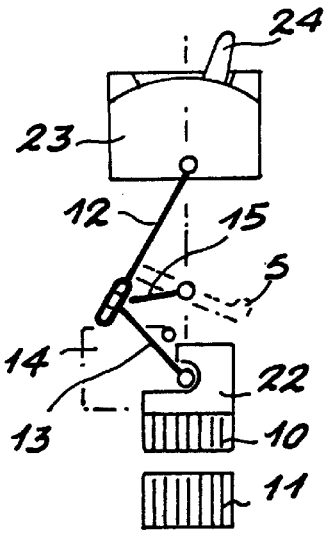
Figure 8:
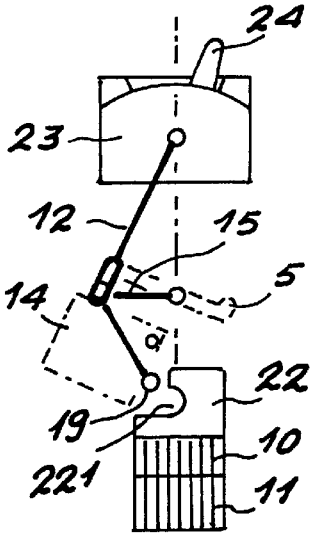

Referring to FIGS. 1 and 6, the contacts are closed, the lock 23 is in the "On" position and the solenoid 8 is energised. This position corresponds to the "On" position of the contactor or of the circuit-breaker. The slider 22 of the solenoid 8 is coupled to the coupling lever 13 which holds the actuator member 15 in the contact closed position. The contact pressure between the contacts of the mobile bridge and the fixed contacts are generated by the pressure springs accommodated in the bridge support.

If the coil of the solenoid is not energised (FIG. 2 or 8), the mobile magnetic circuit 10 is pushed forwards by the springs and the coupling lever 13 pivots the actuator crank 15 and the contact bridges 5 in the direction that opens the contacts. The pin 19 of the coupling lever 13 is guided by the slideway 141 of the locking member 14 which remains immobile during the change from the closed position to the open position and vice versa. The switching poles are opened by the control circuit of the coil, which is the normal contactor function.

Energisation of the solenoid coil moves the mobile magnetic circuit 10 towards the rear which in turn moves the coupling lever 13 and the contact actuator member 15. The contacts on the bridges 5 bear against the fixed contacts 1 and 2. The springs inside the bridge supports press the mobile contacts against the fixed contacts.

The operation of the device as a circuit-breaker will now be described.

The circuit-breaker tripping instructions pass through the lock 23 which operates mechanically on a contact. The lock 23 can be actuated manually via the actuator lever 24 or via the tripping module 4.

The poles closed position shown in FIGS. 1 and 6 is the initial position. When the lock 23 operates (FIGS. 3 and 8), it pulls the lock lever 12 towards the front. The lock lever 12 moves the member 15 and the mobile contacts. The lock lever 12 releases the locking member 14 which can then pivot. The rotation of the actuator crank 15 caused by the movement of the lock lever 12 entrains the coupling lever 13 which pivots the locking member 14 and releases the pin 19 from the notch 221. The switching poles open. Note that there is no longer any positive coupling between the solenoid and the mobile bridges.

To reset the circuit-breaker the operator must close the lock using the lever 24, returning the lock lever 12 to the rear position. The solenoid remains open.

The demountable couplings between the coupling lever 13 and the slider 22 enable demounting and replacement of the demountable combination comprising the cartridges 7 and the lock 23. The conductors mounted in the cartridges must first be separated from the conductors 31 and 32 that carry the terminals and remain in place on the base. Also, the pins 19 must be disengaged from the slider 22, and to achieve this the lock 23 must be in the "Off" position.

Figure 9:
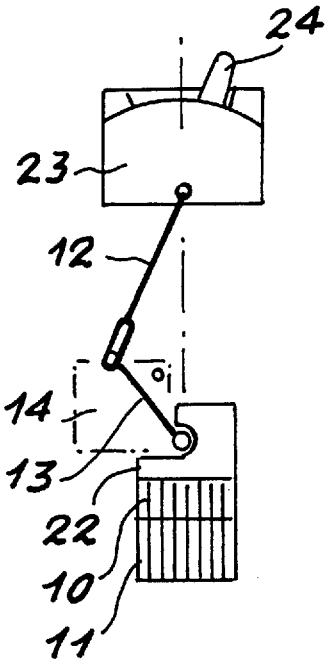
FIGS. 9, 10 and 11 are diagrams showing the operation of an embodiment with contact bridges mobile in translation.
Figure 10:
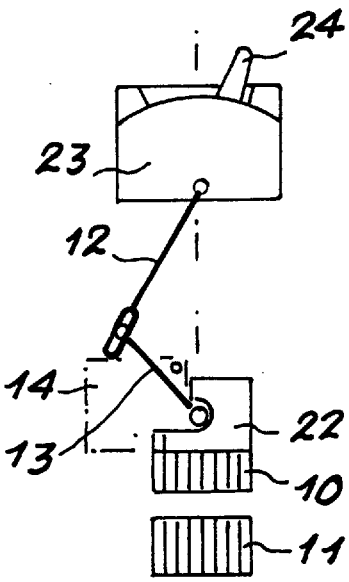
Figure 11:
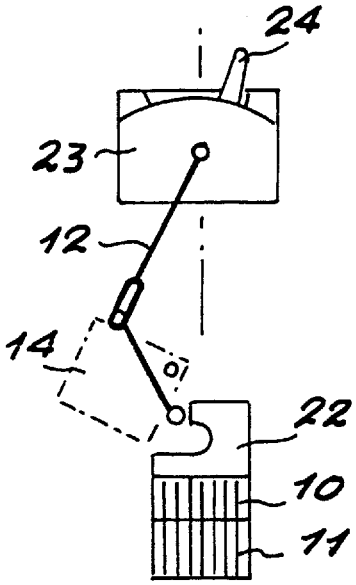

In the embodiment of FIGS. 9 through 11 the supports and contact bridges are mobile in translation rather than in rotation.

It is to be understood that without departing from the scope of the invention variants and improvements can be made and even equivalent means substituted.

I claim:

1. A contactor/circuit breaker switching device comprising:

at least one power switching pole comprising fixed and movable contacts;

an actuator member coupled to said movable contacts for moving said movable contacts;

a lock;

a lock lever linking said lock to said actuator member such that said lock may move said actuator member to open said contacts;

a solenoid;

a coupling lever coupled to said actuator member;

a detachable coupling defined by said solenoid and said coupling lever, said coupling detachably coupling said coupling lever to said solenoid such that said solenoid may move said actuator member to open said contacts; and a locking member operative to detach said detachable coupling in response to a locking state of said lock.

2. The contactor/circuit breaker switching device of claim 1 wherein said detachable coupling includes a hook movable by said solenoid and a finger mounted to said coupling lever and engageable with said hook, and wherein said locking member includes a guide part which selectively retains said finger in engagement with said hook.

3. The contactor/circuit breaker switching device of claim 1 wherein said movable contacts are rotary contacts.

4. The contactor/circuit breaker switching device of claim 2 wherein said locking member is movable between a locking position in which said finger is in engagement with said hook and a release position in which said finger is released from said hook, and wherein said lock lever includes means for maintaining said locking member in said locking position.

5. The contactor/circuit breaker switching device of claim 1 including a cartridge housing said at least one power switching pole.

6. The contactor/circuit breaker switching device of claim 3 including a bridge support rotatably mounting said movable contacts, wherein said actuator member is mounted to said bridge support.

7. The contactor/circuit breaker switching device of claim 1 including a sliding and pivoting joint connecting said lock link and said actuator member.

* * * * *